US007641789B2

(12) United States Patent
Moureaux et al.

(10) Patent No.: US 7,641,789 B2
(45) Date of Patent: Jan. 5, 2010

(54) PROCESS TO PREPARE A BASE OIL HAVING A VISCOSITY INDEX OF BETWEEN 80 AND 140

(75) Inventors: Patrick Moureaux, Petit-Couronne (FR); Johannes Anthonius Robert Van Veen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 744 days.

(21) Appl. No.: 10/537,974

(22) PCT Filed: Dec. 9, 2003

(86) PCT No.: PCT/EP03/50966

§ 371 (c)(1),
(2), (4) Date: Jun. 9, 2005

(87) PCT Pub. No.: WO2004/053029

PCT Pub. Date: Jun. 24, 2004

(65) Prior Publication Data

US 2006/0102518 A1 May 18, 2006

(30) Foreign Application Priority Data

Dec. 9, 2002 (EP) ..... 02293036

(51) Int. Cl.
*C10G 67/04* (2006.01)

(52) U.S. Cl. ..... 208/210; 208/28; 208/33; 208/208 R; 208/209; 208/243; 208/244

(58) Field of Classification Search ..... 208/27, 208/28, 106–110, 113, 121, 33, 208 R, 209–210, 208/243–244
See application file for complete search history.

(56) References Cited

U.S. PATENT DOCUMENTS

| | | | | |
|---|---|---|---|---|
| 3,130,007 | A | 4/1964 | Breck | 23/113 |
| 3,536,605 | A | 10/1970 | Kittrell | 208/59 |
| 4,076,842 | A * | 2/1978 | Plank et al. | 423/704 |
| 4,574,043 | A | 3/1986 | Chester et al. | 208/59 |
| 4,851,109 | A | 7/1989 | Chen et al. | 208/58 |
| 4,859,311 | A | 8/1989 | Miller | 208/89 |
| 4,919,788 | A * | 4/1990 | Chen et al. | 208/59 |
| 5,053,373 | A | 10/1991 | Zones | 502/64 |
| 5,157,191 | A | 10/1992 | Bowes et al. | 585/533 |
| 5,252,527 | A | 10/1993 | Zones | 502/64 |
| 5,378,351 | A | 1/1995 | Guichard et al. | 208/143 |
| 5,543,035 | A * | 8/1996 | Ziemer | 208/111.3 |
| 5,951,848 | A | 9/1999 | Baker, Jr. et al. | 208/28 |
| 6,051,127 | A | 4/2000 | Moureaux | 208/58 |
| 6,576,120 | B1 | 6/2003 | Van Ballegoy et al. | 208/119 |
| 6,723,297 | B2 * | 4/2004 | Chen et al. | 423/326 |
| 7,261,806 | B2 * | 8/2007 | Benard et al. | 208/89 |

FOREIGN PATENT DOCUMENTS

| | | |
|---|---|---|
| CN | 1330699 | 1/2002 |
| EP | 0261758 | 3/1988 |
| EP | 0575077 | 12/1993 |
| EP | 0666894 | 1/1997 |
| EP | 0832171 | 4/1998 |
| GB | 1493620 | 11/1977 |
| WO | 97/18278 | 5/1997 |
| WO | 97/23584 | 7/1997 |
| WO | 99/41337 | 8/1999 |
| WO | 00/29511 | 5/2000 |
| WO | 02/46333 | 6/2002 |

OTHER PUBLICATIONS

Reinhoudt, H.R. et al. (1998). The Evolution of Surface Species in NiW/Al2O3 Catalysts in Various Stages of Sulfidation, Journal of Catalysis, 179, pp. 443-450.*

Speight, J. (1999). Desulfurization of Heavy Oils and Residua, CRC Press, 480 pgs.*

Shimizu, T. et al. (1998). Highly Active Hydrotreatment Catalysts Prepared with Chelating Agents, Catalysis Today, 45, pp. 271-276.* de Bont, P.W., et al. (1998). Ni-sulfide Particles in NaY-zeolite for combined hydrodesulfurization and hydrocracking purposes, Hyperfine Interactions, 111, pp. 39-44.*

Sequeira, Jr., A. (1994). Lubricant Base Oil and Wax Processing. Marcel-Dekker, 288 pgs.*

"Lubricant Base Oil Hydrogen Refining Processes", Lubricant Base Oil and Wax Processing, Avilino Sequeira, Jr., Marcel Dekker, Inc., NY 1994, Chapter 6, pp. 121-131.

"Solvent Dewaxing and Wax Deoiling Process", Lubricant Base Oil and Wax Processing, Avilino Sequeira, Jr., Marcel Dekker Inc., NY 1994, Chapter 7.

Von Bremer H., Jank M., Weber M., Wendlandt K.P., Z. anorg. allg. chem. 505, pp. 79-88, 1983.

Makoto Toba, et al., "Effect of Preparation Methods on Properties of Amorphous Alumina/Silicas", J. Mater. Chem., 1994 4(7), pp. 1131-1135.

A.J.Leonard, et al., "Structure and Properties of Amorphous Silico-Aluminas", Discussions of the Faraday Society,No. 51,1971,pp. 98-108.

W.M. Meier and D.H. Olson, Atlas of Zeolite Structure Types, 3rd edition, Butterworth-Heinemann, 1992, p. 453.

International Search Report dated May 4, 2004.

Kishan, G., et al: "Sulfidation and Thiophene Hydrodesulfurization Activity of Nickel Tungsten Sulfide Model Catalysts, Prepared without and with Chelating Agents", Jrnl of Catalysis, Academic Press, Duluth, MN, US, vol. 196, 2000, pp. 180-189.

* cited by examiner

*Primary Examiner*—Robert J Hill, Jr.
*Assistant Examiner*—Brian McCaig
(74) *Attorney, Agent, or Firm*—Charles W. Stewart

(57) ABSTRACT

Process to prepare a base oil having a viscosity index of between 80 and 140 starting from a distillate or a de-asphalted oil by (a) contacting the feedstock in the presence of hydrogen with a sulphided hydrodesulphurization catalyst comprising nickel and tungsten on an acid amorphous silica-alumina carrier and (b) performing a pour point reducing step on the effluent of step (a) to obtain the base oil.

13 Claims, 3 Drawing Sheets

PROCESS TO PREPARE A BASE OIL HAVING A VISCOSITY INDEX OF BETWEEN 80 AND 140

The present application claims priority to European Patent Application No. 02293036.6 filed 9 Dec. 2002.

The invention is directed to a process to prepare a base oil having a viscosity index of between 80 and 140 starting from a vacuum distillate feed or de-asphalted oil feed by contacting the feedstock in the presence of hydrogen with a catalyst comprising a Group VIB metal and a non-noble Group VIII metal on an amorphous carrier followed by a dewaxing step.

Such a process is well known and for example described in Lubricant Base Oil and Wax Processing, Avilino Sequeira, Jr, Marcel Dekker Inc., New York, 1994, Chapter 6, pages 121-131. According to this publication nickel-tungsten on alumina are the most widely used catalyst for this hydrocracking process. This publication also mentions that some refiners use fluorine injection to enhance catalyst activity.

GB-A-1493620 describes a hydrocracking process to prepare base oils. GB-A-1493620 discloses a catalyst comprising nickel and tungsten as hydrogenation components, supported on an alumina carrier. The required acidity for the catalyst is provided by the presence of fluorine.

In commercial operations the fluorine containing catalyst has proven to be an excellent catalyst for this process in terms of catalyst activity and base oil selectivity. Disadvantages however are that measures have to be taken to avoid fluorine escaping into the environment, that measures have to be taken to avoid corrosion and the cost of having to add fluorine to the process.

It is an object of the present invention to provide a non-fluorided catalyst, which has the same or even improved activity, and/or selectivity to base oils as the fluorided catalysts.

The above aim is achieved with the following process. Process to prepare a base oil starting from a distillate or a de asphalted oil by (a) contacting the feedstock in the presence of hydrogen with a sulphided hydrodesulphurisation catalyst comprising nickel and tungsten on an acid amorphous silica-alumina carrier and (b) performing a pour point reducing step on the effluent of step (a) to obtain the base oil.

DETAILED DESCRIPTION

Figure 1:
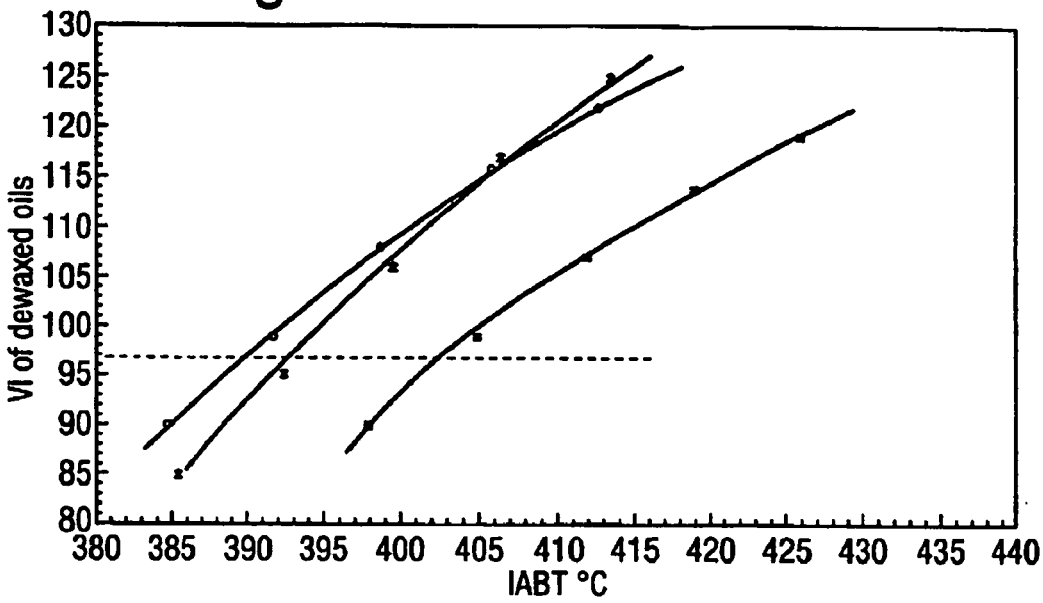
FIG. 1 presents a graph of the viscosity index of base oil samples obtained at different reactor temperatures.

Applicants have found that by using a nickel/tungsten containing catalyst having a relatively high hydrodesulphurisation (HDS) activity and an acid amorphous silica-alumina carrier in step (a) a base oil can be prepared in a high yield. Furthermore the catalytic activity of the catalyst used in step (a) is higher than a state of the art fluorided nickel-tungsten catalyst. A next advantage is that the content of (poly)aromatic compounds in the base oil is lower when using the process according to the invention as compared to when a fluorided nickel-tungsten catalyst is used under comparable process conditions.

The distillate feed to step (a) is suitably a fraction boiling in the base oil boiling range. The base oil boiling range boils suitably above 350 and more typically above 370° C. From distillate feeds it is possible to prepare base oil products having a kinematic viscosity at 100° C. of above 2 cSt and typically between 2 and 15 cSt. Such distillate feeds are preferably obtained by distillation of a suitably mineral crude petroleum source at atmospheric pressure conditions. The residue thus obtained is subsequently further distilled at vacuum pressure conditions in to one or more distillate fractions and a so-called vacuum residue. These distillate fractions can be used as feed to step (a). The vacuum residue or the residue as obtained in the above described atmospheric distillation of a crude petroleum source may also be used as feed to step (a) after separation of asphalt compounds by well known de-asphalting processes which yield a so-called de-asphalted oil. From de-asphalted oil the more viscous base oils are prepared having a kinematic viscosity at 100° C. of between 25 to 35 cSt.

The wax content of the feed to step (a), as measured by solvent dewaxing at −27° C. in MEK/Toluene, of the feed to step (a) will be typically below 30 wt % and more typically below 20 wt %.

The catalyst employed in step (a) preferably comprises between 2-10 wt % nickel and between 5-30 wt % tungsten.

The sulphided hydrodesulphurisation catalyst used in step (a) has a relatively high hydrodesulphurisation activity. With relatively high activity is here meant a considerably higher activity when compared to state of the art nickel/tungsten containing catalysts based on a silica-alumina carrier. Preferably the hydrodesulphurisation activity of the catalyst is higher than 30% and more preferably below 40%, and most preferably below 35%, wherein the hydrodesulphurisation activity is expressed as the yield in weight percentage of $C_4$-hydrocarbon cracking products when thiophene is contacted with the catalyst under standard hydrodesulphurisation conditions. The standard conditions consists of contacting a hydrogen/thiophene mixture with 200 mg of a 30-80 mesh sulphided catalyst at 1 bar and 350° C., wherein the hydrogen rate is 54 ml/min and the thiophene concentration is 6 vol % in the total gas feed.

Catalyst particles are to be used in the test are first crushed and sieved through a 30-80 mesh sieve. The catalyst is then dried for at least 30 minutes at 300° C. before loading 200 mg of dried catalyst into a glass reactor. Then the catalyst is pre-sulphided by contacting the catalyst for about 2 hours with an $H_2S/H_2$ mixture, wherein the $H_2S$ rate is 8.6 ml/min and the $H_2$ rate is 54 ml/min. The temperature during the pre-sulphiding procedure is raised from room temperature, 20° C., to 270° C. at 10° C./min and held for 30 minutes at 270° C. before raising it to 350° C. at a rate of 10° C./min. During pre-sulphiding nickel and tungsten oxides are converted to the active metal sulphides. After pre-sulphiding the $H_2S$ flow is stopped and $H_2$ is bubbled at a rate of 54 ml/min through two thermostatted glass vessels containing thiophene. The temperature of the first glass vessel is kept at 25° C. and the temperature of the second glass vessel is kept at 16° C. As the vapour pressure of thiophene at 16° C. is 55 mmHg, the hydrogen gas that enters the glass reactor is saturated with 6 vol % thiophene. The test is performed at 1 bar and at a temperature of 350° C. The gaseous products are analysed by an online gas liquid chromatograph with a flame ionisation detector every 30 minutes for four hours.

In order to obtain a reproducible value for the hydrodesulphurisation activity the test values as obtained by the above method are corrected such to correspond to the hydrodesulphurisation activity of a reference catalyst. The reference catalyst is the commercial C-454 catalyst as obtainable at the date of filing of Criterion Catalyst Company (Houston) and its reference hydrodesulphurisation activity is 22 wt % according to the above test. By testing both the reference catalyst ("test C-454") and the test catalyst ("measured val") one can easily calculate a consistent actual hydrodesulphurisation activity according to the above test with the below equation:

Actual activity="measured *val*"+((22−"test *C*-454")/22)*"measured *val*"

The hydrodesulphurisation activity of the nickel/tungsten catalyst can be improved by using chelating agents in the impregnation stage of the preparation of the catalyst as for example described by Kishan G., Coulier L., de Beer V. H. J., van Veen J. A. R., Niemantsverdriet J. W., Journal of Catalysis 196, 180-189 (2000). Examples of chelating agents are nitrilotriacetic acid, ethylenediaminetetraacetic acid (EDTA) and 1,2-cyclohexanediamine-N,N,N',N',-tetraacetic acid.

The carrier for the catalyst is amorphous silica-alumina. The term "amorphous" indicates a lack of crystal structure, as defined by X-ray diffraction, in the carrier material, although some short range ordering may be present. Amorphous silica-alumina suitable for use in preparing the catalyst carrier is available commercially. Alternatively, the silica-alumina may be prepared by precipitating an alumina and a silica hydrogel and subsequently drying and calcining the resulting material, as is well known in the art. The carrier is an amorphous silica-alumina carrier. The amorphous silica-alumina preferably contains alumina in an amount in the range of from 5 to 75% by weight, more preferably from 10 to 60% by weight as calculated on the carrier alone. A very suitable amorphous silica-alumina product for use in preparing the catalyst carrier comprises 45% by weight silica and 55% by weight alumina and is commercially available (ex. Criterion Catalyst Company, USA).

The total surface area of the catalyst as determined by is preferably above 100 $m^2/g$ and more preferably between 200 and 300 $m^2/g$. The total pore volume is preferably above 0.4 ml/g. The upper pore volume will be determined by the minimum surface area required. Preferably between 5 and 40 volume percent of the total pore volume is present as pores having a diameter of more than 350 Å. References to the total pore volume are to the pore volume determined using the Standard Test Method for Determining Pore Volume Distribution of Catalysts by Mercury Intrusion Porosimetry, ASTM D 4284-88.

The catalyst is sulphided. Sulphidation of the catalyst may be effected by any of the techniques known in the art, such a ex-situ or in-situ sulphidation. For example, Sulphidation may be effected by contacting the catalyst with a sulphur-containing gas, such as a mixture of hydrogen and hydrogen sulphide, a mixture of hydrogen and carbon disulphide or a mixture of hydrogen and a mercaptan, such as butylmercaptan. Alternatively, sulphidation may be carried out by contacting the catalyst with hydrogen and sulphur-containing hydrocarbon oil, such as sulphur-containing kerosene or gas oil. The sulphur may also be introduced into the hydrocarbon oil by the addition of a suitable sulphur-containing compound, for example dimethyldisulphide or tertiononylpolysulphide.

The feedstock will preferably comprise a minimum amount of sulphur in order to keep the catalyst in a sulphided state. Preferably at least 200 ppm sulphur and more preferably at least 700 ppm sulphur is present in the feed to step (a). It may be therefore be necessary to add additional sulphur, for example as dimethylsulphide, or a sulphur containing co-feed to the feed of step (a) if the feed contains a lower level of sulphur.

The amorphous silica-alumina carrier of the catalyst preferably has a certain minimum acidity or, said in other words, a minimum cracking activity. Examples of suitable carriers having the required activity are described in WO-A-9941337. More preferably the catalyst carrier, after having been calcined, at a temperature of suitably between 400 and 1000° C., has a certain minimum n-heptane cracking activity as will be described in more detail below.

The n-heptane cracking is measured by first preparing a standard catalyst consisting of the calcined carrier and 0.4 wt % platinum. Standard catalysts are tested as 40-80 mesh particles, which are dried at 200° C. before loading in the test reactor. The reaction is carried out in a conventional fixed-bed reactor having a length to diameter ratio of 10 to 0.2. The standard catalysts are reduced prior to testing at 400° C. for 2 hrs at a hydrogen flow rate of 2.24 Nml/min and a pressure of 30 bar. The actual test reaction conditions are: n-heptane/$H_2$ molar ratio of 0.25, total. pressure 30 bar, and a gas hourly space velocity of 1020 Nml/(gh). The temperature is varied by decreasing the temperature from 400° C. to 200° C. at 0.22° C./minute. Effluents are analysed by on-line gas chromatography. The temperature at which 40 wt % conversion is achieved is the n-heptane test value. Lower n-heptane test values correlate with more active catalyst.

Preferred carriers have an n-heptane cracking temperature of less than 360° C., more preferably less than 350° C. and most preferably less than 345° C. as measured using the above-described test. The minimum n-heptane cracking temperature is preferably more than 310° C. and more preferably greater than 320° C.

The cracking activity of the silica-alumina carrier can be influenced by, for example, variation of the alumina distribution in the carrier, variation of the percentage of alumina in the carrier, and the type of alumina, as is generally known to one skilled in the art. Reference in this respect is made to the following articles which illustrate the above: Von Bremer H., Jank M., Weber M., Wendlandt K. P., Z. anorg. allg. Chem. 505, 79-88 (1983); Léonard A. J., Ratnasamy P., Declerck F. D., Fripiat J. J., Disc. of the Faraday Soc. 1971, 98-108; and Toba M. et al, J. Mater. Chem., 1994, 4(7), 1131-1135.

The catalyst preferably comprises up to 8 wt % of a large pore molecular sieve, preferably an aluminosilicate zeolite. More preferably the catalysts comprises between 0.1 and 8 wt % of a molecular sieve. It has been found that such catalysts are even more active than the above described catalysts not comprising a molecular sieve. The improved activity is especially noticed when base oils are prepared which have a viscosity index of between 120 and 140. A next advantage is that an improved saturation of both mono/ and poly aromatics is observed. Such zeolites are well known in the art, and include, for example, zeolites such as X, Y, ultrastable Y, dealuminated Y, faujasite, ZSM-12, ZSM-18, L, mordenite, beta, offretite, SSZ-24, SSZ-25, SSZ-26, SSZ-31, SSZ-33, SSZ-35 and SSZ-37, SAPO-5, SAPO-31, SAPO-36, SAPO-40, SAPO-41 and VPI-5. Large pore zeolites are generally identified as those zeolites having 12-ring pore openings. W. M. Meier and D. H. Olson, "ATLAS OF ZEOLITE STRUCTURE TYPES" 3rd Edition, Butterworth-Heinemann, 1992, identify and list examples of suitable zeolites. If a large pore molecular sieve is used then the well-known synthetic zeolite Y as for example described in U.S. Pat. No. 3,130,007 and ultrastable Y zeolite as for example described in U.S. Pat. No. 3,536,605 are suitable molecular sieves. Other suitable molecular sieves are ZSM-12, zeolite beta and mordenite.

The catalyst for use in step (a) may be prepared by any of the suitable catalyst preparation techniques known in the art. A preferred method for the preparation of the carrier comprises mulling a mixture of the amorphous silica-alumina and a suitable liquid, extruding the mixture and drying and calcining the resulting extrudates as for example described in EP-A-666894. The extrudates may have any suitable form known in the art, for example cylindrical, hollow cylindrical, multilobed or twisted multilobed. A most suitable shape for the catalyst particles is cylindrical. Typically, the extrudates have a nominal diameter of from 0.5 to 5 mm, preferably from 1 to 3 mm. After extrusion, the extrudates are dried. Drying may be effected at an elevated temperature, preferably up to 800° C., more preferably up to 300° C. The period for drying is typically up to 5 hours, preferably from 30 minutes to 3 hours. Preferably, the extrudates are calcined after drying. Calcination is effected at an elevated temperature, preferably between 400 and 1000° C. Calcination of the extrudates is typically effected for a period of up to 5 hours, preferably from 30 minutes to 4 hours. Once the carrier has been prepared, nickel and tungsten may be deposited onto the carrier material. Any of the suitable methods known in the art may be employed, for example ion exchange, competitive ion exchange and impregnation. Preferably nickel and tungsten are added by means of impregnation using a chelating agent as described above. After impregnation, the resulting catalyst is preferably dried and calcined at a temperature of between 200 and 500° C.

Step (a) is conducted at elevated temperature and pressure. Suitable operating temperatures for the process are in the range of from 290° C. to 450° C., preferably in the range of from 360° C. to 420° C. Preferred total pressures are in the range of from 20 to 180 bar and more preferred from 100-180 bar. The hydrocarbon feed is typically treated at a weight hourly space velocity in the range of from 0.3 to 1.5 kg/l/h, more preferably in the range of from 0.3 to 1.2 kg/l/h.

The feed may be contacted with the catalyst in the presence of pure hydrogen. Alternatively, it may be more convenient to use a hydrogen-containing gas, typically containing greater than 50% vol. hydrogen, more preferably greater than 60% vol hydrogen. A suitable hydrogen-containing gas is gas originating from a catalytic reforming plant. Hydrogen-rich gases from other hydrotreating operations may also be used. The hydrogen-to-oil ratio is typically in the range of from 300 to 5000 l/kg, preferably from 500 to 2500 l/kg, more preferably 500 to 2000 l/kg, the volume of hydrogen being expressed as standard litres at 1 bar and 0° C.

Preferably the feed to step (a) is subjected to a hydrodesulphurisation (HDS) step prior using the feed in step (a). Especially when base oils are desired having a viscosity index of below 120. Suitable HDS catalysts which may be used comprise a Group VIII non-noble metal, for example nickel or cobalt, and a Group VIB metal, for example tungsten or molybdenum. Preferred catalysts for use in the process according to the present invention are catalysts comprising nickel and molybdenum, for example KF-847 and KF-8010 (AKZO Nobel) M-8-24 and M-8-25 (BASF), and C-424, DN-3100, DN-3120, HDS-3 and HDS-4 (Criterion Catalyst Company). The HDS treatment of the feed is preferably performed in the same reactor as wherein step (a) is performed, for example in a stacked bed configuration, wherein the top bed comprises of the HDS catalyst. The process conditions with respect to hydrogen to oil ratio, pressure and temperature will as a consequence be comparable to those in step (a). The feed is suitably treated at a weight hourly space velocity in the range of from 0.3 to 1.5 kg/l/h, more preferably in the range of from 0.3 to 1.2 kg/l/h.

In step (b) the effluent of step (a) is subjected to a pour point reducing treatment. Before performing a pour point reducing step (b) gaseous fraction comprising hydrogen sulphide and ammonia are preferably separated. More preferably also the fraction boiling up to and including the middle distillate boiling range are separated by means of flashing and/or distillation from the effluent of step (a) before performing step (b).

With a pour point reducing treatment is understood every process wherein the pour point of the base oil is reduced by more than 10° C., preferably more than 20° C., more preferably more than 25° C.

The pour point reducing treatment can be performed by means of a so-called solvent dewaxing process or by means of a catalytic dewaxing process. Solvent dewaxing is well known to those skilled in the art and involves admixture of one or more solvents and/or wax precipitating agents with the base oil precursor fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

Alternatively step (b) is performed by means of a catalytic dewaxing process. Such a process is preferred when for example lower pour points are desired than which can be achieved with solvent dewaxing. Pour points of well below −30° C. can be easily achieved. The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the base oil precursor fraction under catalytic dewaxing conditions. Preferably the intermediate pore size zeolites have a pore diameter of between 0.35 and 0.8 nm. Suitable intermediate pore size zeolites are ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 5,053,373, U.S. Pat. No. 5,252,527 and U.S. Pat. No. 4,574,043.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material which is essentially free of alumina is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. These catalysts may be advantageously used because they allow small amounts of sulphur and nitrogen in the feed. A preferred dealumination treatment is by contacting an extrudate of the binder and the zeolite with an aqueous solution of a fluorosilicate salt as described in for example U.S. Pat. No. 5,157,191 or WO-A-0029511. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171 of which the ZSM-23, ZSM-22 and ZSM-12 based catalysts are even more preferred because of their high base oil yield.

Catalytic dewaxing conditions are known in the art and typically involve operating temperatures in the range of from 200 to 500° C., suitably from 250 to 400° C., hydrogen pressures in the range of from 10 to 200 bar. Although lower pressures between 40 to 70 bar are generally preferred for the dewaxing step, the pressure can suitably be in the same range as step (a) when steps (a) and (b) are operated as an integrated process. Thus when step (a) is performed at a pressure above 70 bar, the dewaxing step will suitably also be performed at a pressure above 70 bar. The weight hourly space velocities (WHSV) is suitably in the range of from 0.1 to 10 kg of oil per liter of catalyst per hour (kg/l/hr), and preferably from 0.2 to 5 kg/l/hr, more preferably from 0.5 to 3 kg/l/hr and hydrogen to oil ratios in the range of from 100 to 2,000 liters of hydrogen per liter of oil.

The effluent of step (b) has been found to contain very low contents of (poly) aromatic compounds. This is advantageous because an additional hydrofinishing step may thus be omitted.

The invention will be illustrated with the following non-limiting examples.

EXAMPLE 1

A nickel/tungsten on silica/alumina catalyst, LH-21 catalyst as obtained from Criterion Catalyst Company (Houston) was loaded into a reactor and retained as a fixed bed. The LH-21 catalyst had a hydrodesulphurisation activity of 32% alumina . The carrier of this catalyst had a heptane cracking test value of between 320 and 345° C.

TABLE 1

| Blend of de-asphalted oil and heavy distillate | | Boiling curve (° C.) | |
|---|---|---|---|
| Wax (wt %) | 9.9 | Initial boiling point | 385 |
| S (wt %) | 2.75 | 10 wt % boiling point | 465 |
| N (ppmw) | 975 | 50 wt % boiling point | 515 |
| Kinematic viscosity at 100° C. (cSt) | 25 | 90 wt % boiling point | 614 |
| Mono aromatics (mmol-100 g) | 60 | Final boiling point | 707 |
| Poly aromatics (mmol-100 g) | 66 | | |
| Density at 70° C. | 902 | | |

A blend of a de-asphalted oil and a heavy distillate oil which has the properties as listed in Table 1 was fed to the reactor at a weight hourly space velocity of 1 kg/l/h. Hydrogen was fed to the reactor at an inlet pressure of 160 bar and at a flowrate of 1000 Nl/h. The reaction temperature (IABT) was varied between 380 and 430° C.

The hydrocarbon product was distilled to remove that fraction of the product having a boiling point below 370° C. and further refined by solvent dewaxing at a temperature of −20° C. to yield a base oil.

The viscosity index of the resulting base oil samples as obtained at the different reactor temperatures were measured and presented in FIG. 1.

Figure 2:
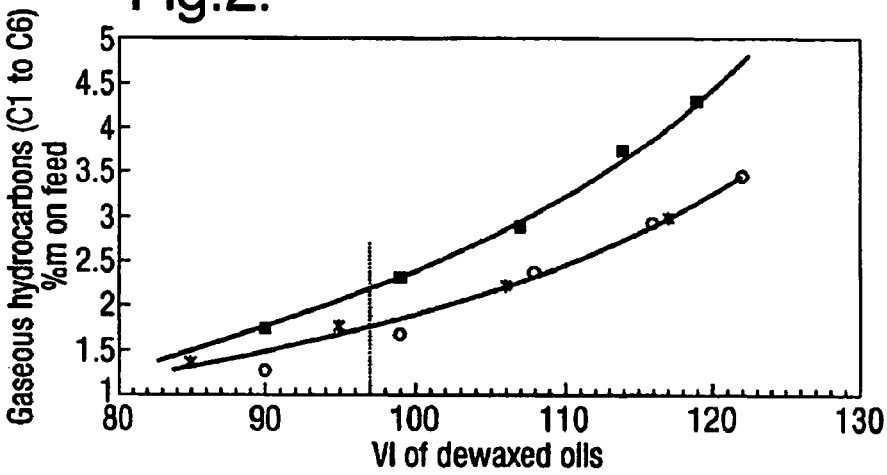
FIG. 2 presents a graph of the fraction of gaseous hydrocarbons in an effluent as a function of viscosity index of a base oil.

The fraction of gaseous hydrocarbons having 1 to 6 carbon atoms in the effluent of step (a) was measured and presented in FIG. 2 as a function of the viscosity index of the resulting base oil.

Figure 3:
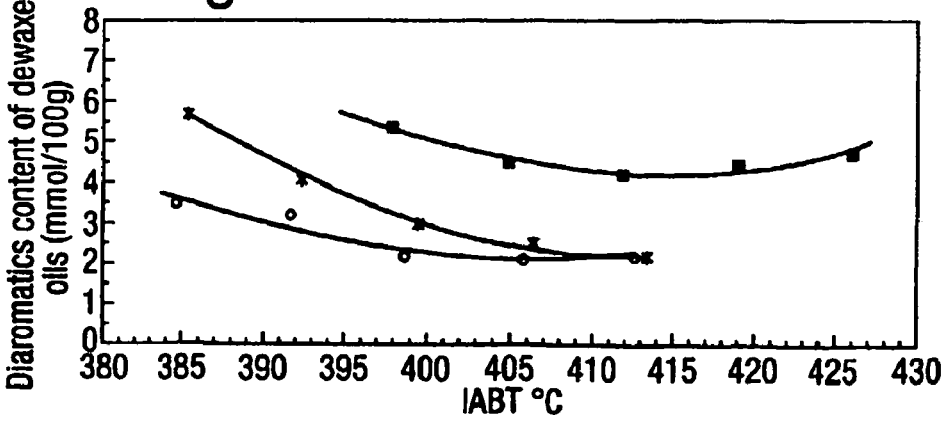
FIG. 3 presents a graph of the poly-aromatics in a base oil as a function of viscosity index.

The poly-aromatic compounds (having more than two rings) was measured in the base oil and presented in FIG. 3 as a function of the viscosity index.

Figure 4:
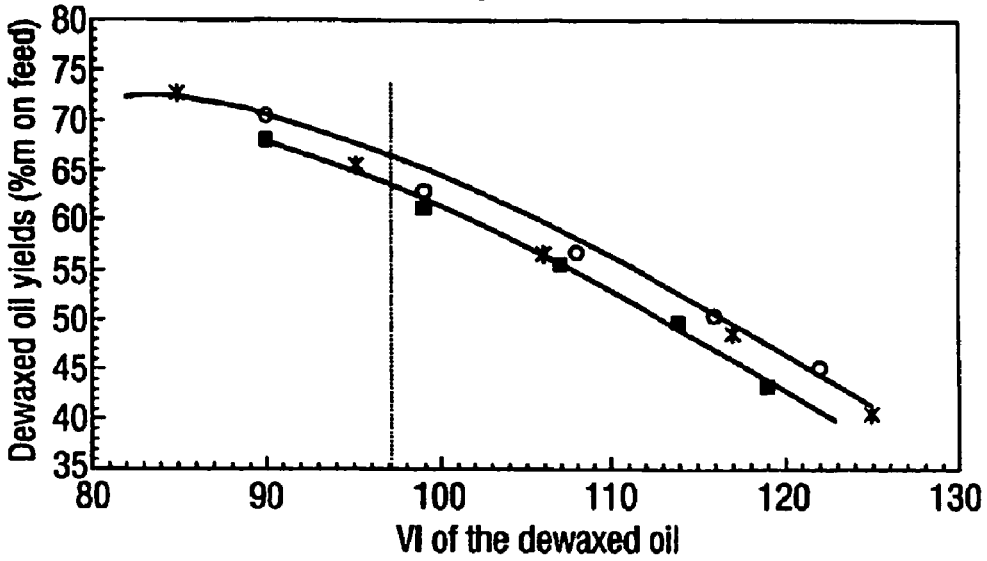
FIG. 4 presents a graph of the base oil yield as a function of viscosity index.

The yield to base oil as measured on the feed of Table 1 as a function of the viscosity index was measured and presented in FIG. 4.

The results of Example 1 in FIGS. 1-4 are presented as an X (x).

EXAMPLE 2

Example 1 was repeated except that the upstream half of the LH-21 catalyst bed was replaced by a commercial nickel/molybdenum HDS catalyst. The results are presented in FIGS. 1-4 as an non-filed circle (○).

Comparative Experiment A

Example 1 was repeated with a commercial fluorided C-454 catalyst as obtained from the Criterion Catalyst Company. The results are presented in FIGS. 1-4 as black boxes (■).

FIGS. 1-3 show that the process according to the present invention and illustrated by Examples 1 and 2 can be operated at a lower temperature to achieve the same viscosity index base oil as compared to when the fluorided catalyst was used. The yield to base oils is better with the invented process as shown in FIG. 4. The activity gain as illustrated of about 10° C. is significant (FIG. 1). Such an improvement in such a process is equivalent to doubling the space velocity, i.e. reducing the catalyst load by a factor two. Furthermore less gaseous by-products are formed in step (a) and the content of di-aromatic compounds in the final base oil is less as compared to when the fluorided C-454 catalyst is used.

EXAMPLE 3

A nickel/tungsten on silica/alumina catalyst, LH-21 catalyst as obtained from Criterion Catalyst Company (Houston) was modified such that it also comprised 2 wt % (as calculated on the carrier) of very ultra stable zeolite Y. This modified catalyst was loaded into a reactor and retained as a fixed bed.

Upstream this catalyst bed the same volume of a HDS catalyst, DN-3100 as obtained from the Criterion Catalyst Company, was placed.

TABLE 2

| | | |
|---|---|---|
| Sulphur content | wt % | 3.08 |
| Nitrogen content | Mg/kg | 1135 |
| Density at 70° C. | | 0.9019 |
| Wax content | wt % | 8 |
| Kinematic viscosity at 100° C. | cSt | 17.4 |
| Mono aromatics | mmol/100 g | 47 |
| Poly aromatics | " | 48 |
| IBP | ° C. | 397 |
| 30% m | " | 480 |
| 50% m | " | 498 |
| 90% m | " | 541 |
| Final boiling point | " | 593 |

An Arabian medium distillate having the properties as listed in Table 2 was fed to the reactor at a weight hourly space velocity of 1 kg/l/h (as defined over the whole reactor). Hydrogen was fed to the reactor at an inlet pressure of 160 bar and at a flowrate of 1700 Nl/h. The reaction temperature (IABT) was varied between 370 and 410° C.

The hydrocarbon product was distilled to remove that fraction of the product having a boiling point below 390° C. and further refined by solvent dewaxing at a temperature of −20° C. to yield a base oil.

Figure 5:
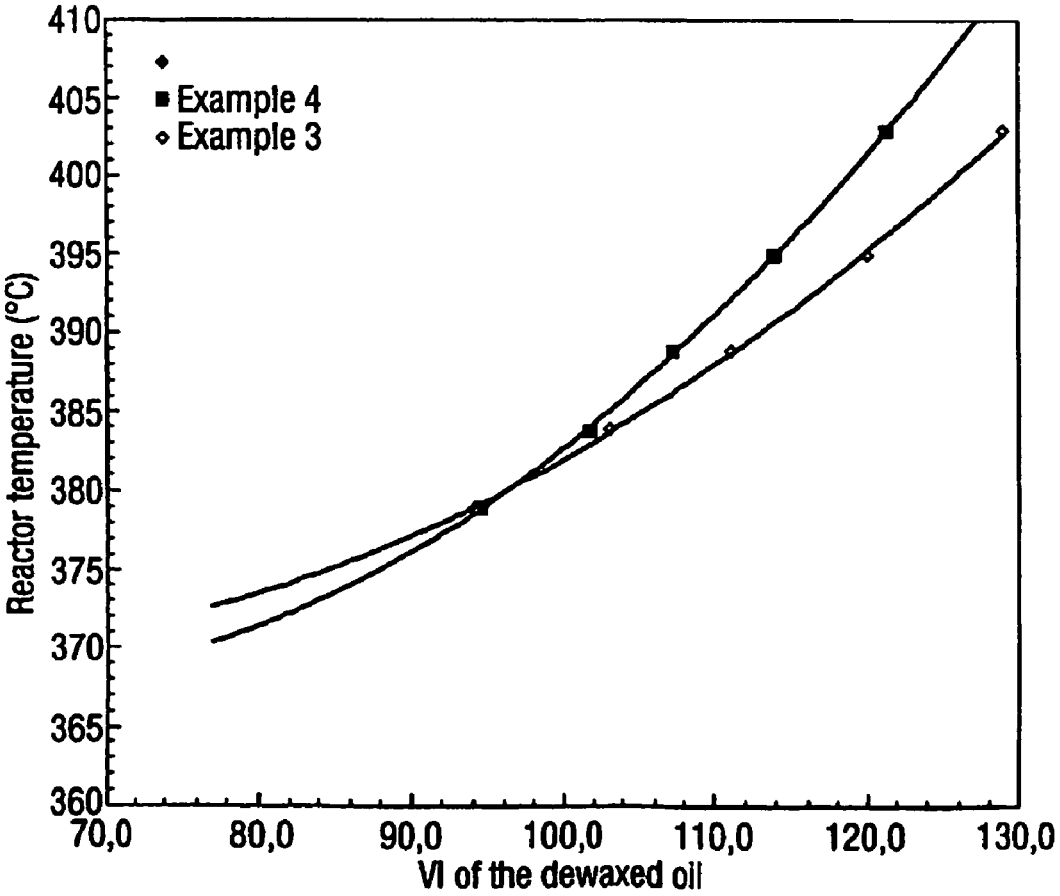
FIG. 5 presents a graph of the viscosity index of base oil samples obtained at different reactor temperatures.

The viscosity index of the resulting base oil samples as obtained at the different reactor temperatures were measured and presented in FIG. 5.

Figure 6:
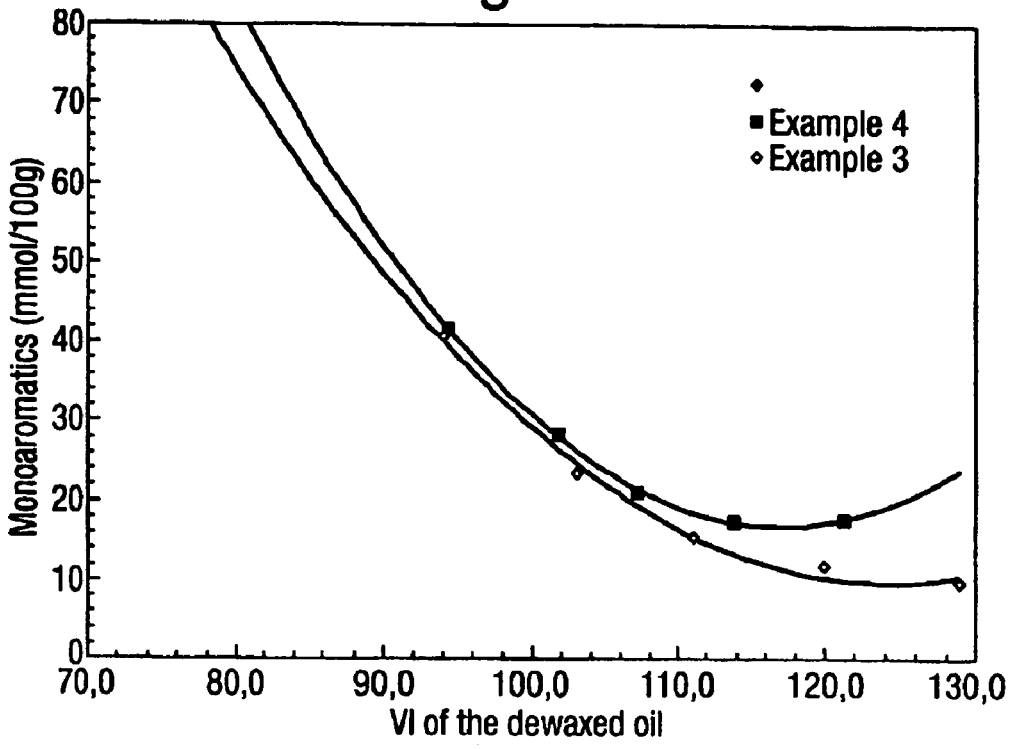
FIG. 6 presents a graph of the mono-aromatics in certain base oils.

The content of mono-aromatics (mmol/100 g) in the base oil was measured and presented in FIG. 6.

Figure 7:
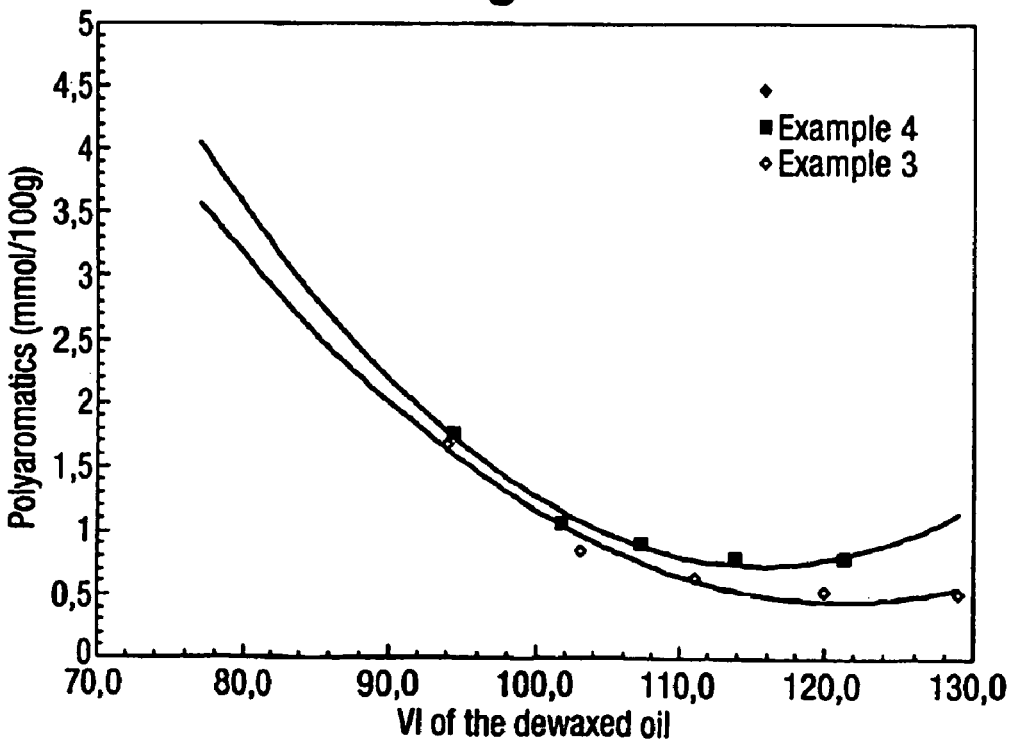
FIG. 7 presents a graph of the mono-aromatics in certain base oils.

The poly-aromatic compounds (having two and more rings) was measured in the base oil and presented in FIG. 7.

EXAMPLE 4

Example 3 was repeated except that the non-modified LH-21 catalyst was used in the downstream catalyst bed. The viscosity index of the resulting base oil samples as obtained at the different reactor temperatures were measured and presented in FIG. 5.

The content of mono-aromatics (mmol/100 g) in the base oil was measured and presented in FIG. 6.

The poly-aromatic compounds (having two and more rings) was measured in the base oil and presented in FIG. 7.

EXAMPLE 5

A waxy distillate was contacted with a catalyst as in Example 1 to obtain an intermediate product having the properties as listed in Table 3 as feed. This feed was catalytically dewaxed by contacting the feed at different conditions as listed in Table 3 with a catalyst consisting of 30 wt % of surface dealuminated ZSM-12 on a silica carrier loaded with 0.7% Pt. This catalyst was prepared according to the method described in the Examples of U.S. Pat. No. 6,576,120.

TABLE 3

| | | | Example number | | |
|---|---|---|---|---|---|
| | | feed | 5a | 5b | 5c |
| Operating conditions | | | | | |
| Pressure | bars | | 66 | 66 | 66 |
| Temperature | ° C. | | 310 | 315 | 305 |
| WHSV | l/l · h | | 0.872 | 0.901 | 0.879 |
| Hydrogen flow | Nl/l | | 524 | 508 | 520 |
| Properties of distilled oil | | | | | |
| refractive index@70° C. | | 1.4490 | | | |
| Oil content at (wt %) | −27° C. | 83.4 | | | |
| Nitrogen content | mg/kg | 2 | | | |
| Sulphur content | mg/kg | 5 | | | |
| Kinematic viscosity at 100° C. | cSt | 4.451 | | | |
| Initial boiling point | ° C. | 334 | 345 | 356 | 356 |
| Final boiling point | ° C. | 511 | 514 | 515 | 507 |
| Density@70° C. | | | 815.6 | 817.6 | 814.6 |
| pour point | ° C. | | −23 | −34 | −15 |
| Kinematic viscosity at 40° C. | $mm^2/s$ | | 24.43 | 28.84 | 23.95 |
| Kinematic viscosity at 100° C. | $mm^2/s$ | | 4.646 | 5.112 | 4.632 |
| VI | | | 106 | 105 | 109 |
| Dewaxing Yield | Wt % | | 84.3 | 80.7 | 87.4 |

EXAMPLE 6

Example 5 was repeated except in that for the dewaxing catalyst the ZSM-5 was substituted for ZSM-12. For achieving a base oil having a pour point of −15° C. a base oil yield was observed of 78.5 wt % . The viscosity index of this base oil was 104.

That which is claimed is:

1. A process to prepare a base oil having a viscosity index of between 80 and 140 starting with a feedstock having at least 200 ppm sulfur and is either a distillate or a de-asphalted oil, wherein said process comprises:

(a) contacting the feedstock in the presence of hydrogen with a sulphided, non-fluorided hydrodesulphurisation catalyst, comprising between 2-10 wt % nickel, between 5-30 wt % tungsten, an acid amorphous silica-alumina carrier, between 0.1 and 8 wt % large pore molecular sieve and alumina in an amount in the range of from 5 to 75% by weight calculated on the carrier alone, and wherein the sulphided, non-fluorided hydrodesulphurisation catalyst has a surface area between 200 and 300 $m^2/g$, a total pore volume above 0.4 ml/g, and between 5 and 40 volume percent of its total pore volume present as pores having a diameter of more than 350 Å, to thereby provide an effluent; and (b) separating the effluent into a low boiling fraction and a high boiling fraction; and (c) performing a pour point reducing step on the high boiling fraction to obtain the base oil.

2. The process according to claim 1, wherein the sulphided, non-fluorided hydrodesulphurisation catalyst has a hydrodesulphurisation activity of higher than 30%, wherein the hydrodesulphurisation activity is expressed as the yield in weight percentage of $C_4$-hydrocarbon cracking products when thiophene is contacted with the catalyst under standard hydrodesulphurisation conditions, wherein the standard conditions consist of contacting a hydrogen-thiophene mixture with 200 mg of a 30-80 mesh catalyst at 1 bar and 350° C., wherein the hydrogen rate is 54 ml/min and the thiophene concentration is 6 vol % in the mixture.

3. The process according to claim 2, wherein the sulphided, non-fluorided hydrodesulphurisation catalyst is obtained in a process wherein the nickel and the tungsten are impregnated on the acid amorphous silica-alumina carrier in the presence of a chelating agent.

4. The process according to claim 3, wherein the alumina content of the sulphided, non-fluorided hydrodesulphurisation catalyst is between 10 and 60 wt % as calculated on the carrier alone.

5. The process according to claim 4, wherein the silica-alumina carrier has an n-heptane cracking test value of between 310 and 360° C., wherein the cracking test value is obtained by measuring the temperature at which 40 wt % of n-heptane is converted when contacted, under standard test conditions, with a catalyst consisting of said carrier and 0.4 wt % platinum.

6. The process according to claim 5, wherein the silica-alumina carrier has an n-heptane cracking test value of between 320 and 350° C.

7. The process according to claim 6, wherein the feedstock contains more than 700 ppm sulphur.

8. The process according to claim 7, wherein the feedstock is first subjected to a hydrodesulphurisation step prior to the contacting step (a).

9. The process according to claim 8, wherein the large pore molecular sieve is zeolite Y, ultrastable zeolite Y, ZSM-12, zeolite beta or mordenite molecular sieve.

10. The process according to claim 9, wherein step (c) is performed by means of solvent dewaxing.

11. The process according to claim 9, wherein step (c) is performed by means of catalytic dewaxing.

12. The process according to claim 11, wherein the dewaxing catalyst is selected from the group consisting of a catalyst composition A comprising a silica bound and dealuminated Pt/ZSM-12, a catalyst composition B comprising a silica bound and dealuminated Pt/ZSM-22, and a catalyst composition C comprising a silica bound and dealuminated Pt/ZSM-23.

13. The process according to claim 12, wherein the dewaxing catalyst is a silica bound and dealuminated Pt/ZSM-12.

* * * * *